United States Patent [19]

Nakazima

[11] 4,310,740

[45] Jan. 12, 1982

[54] PROCESS FOR PRODUCING LARGE-SIZED RECTANGULAR OR SQUARE STEEL PIPES

[75] Inventor: Norio Nakazima, Fukui, Japan

[73] Assignee: Kabushikikaisha Nakazima, Osaka, Japan

[21] Appl. No.: 48,535

[22] Filed: Jun. 13, 1979

[30] Foreign Application Priority Data

Jul. 7, 1978 [JP] Japan ..... 53/83411

[51] Int. Cl.[3] ..... B23K 31/06

[52] U.S. Cl. ..... 219/61.11; 219/59.1; 219/61.2; 228/151; 228/17.5; 72/52

[58] Field of Search ..... 219/8.5, 59.1, 61.1, 219/61.11, 61.2; 228/146, 147, 173 F, 17.5, 150, 151; 72/51, 52, 370

[56] References Cited

U.S. PATENT DOCUMENTS

| | | | |
|---|---|---|---|
| 3,263,053 | 7/1966 | Rudd | 219/61.2 |
| 3,337,944 | 8/1967 | Morris | 219/8.5 X |
| 3,603,761 | 9/1971 | Wogerbauer | 219/59.1 |
| 3,640,116 | 2/1972 | Hellman | 72/370 X |
| 4,083,221 | 4/1978 | Whitted | 73/370 X |
| 4,099,662 | 7/1978 | Nakajima | 228/17.5 X |
| 4,142,663 | 3/1979 | Blatnik et al. | 228/17.5 X |

FOREIGN PATENT DOCUMENTS

| | | | |
|---|---|---|---|
| 1228676 | 8/1960 | France | 219/8.5 |
| 1355978 | 6/1974 | United Kingdom | 219/59.1 |

*Primary Examiner*—Gene Z. Rubinson
*Assistant Examiner*—Keith E. George
*Attorney, Agent, or Firm*—Jordan and Hamburg

[57] ABSTRACT

A process for producing large-sized steel pipe of rectangular or square configuration from a single plate includes providing a predetermined length of steel plate. The plate is bent to form a longitudinally extending base, opposed sidewalls and a top wall. The top wall is constituted by inwardly directed extensions of the sidewalls which terminate in spaced apart longitudinally extending edges. The sidewalls are angularly disposed relative to the base. At least one inner roller having outwardly facing substantially planar surfaces is positioned within the bent plate upon the base thereof. Outer rollers are positioned externally of the bent plate so as to be cooperable with the underside of the base and with the sidewalls. Relative longitudinal movement between the rollers and the bent plate is effected, the outer sidewall rollers are pressed against the planar surfaces of the inner rollers, and the longitudinally extending edges are brought into substantially abutting relationship. The steel plate, configured into the desired shape, is then welded.

1 Claim, 5 Drawing Figures

11
12
13
14
15
16
17
18
19
21
A
B
51
52
53
54
54a
55
56
57
58
5

PROCESS FOR PRODUCING LARGE-SIZED RECTANGULAR OR SQUARE STEEL PIPES

BACKGROUND OF THE INVENTION

The present invention relates to a process for producing large-sized steel pipes of rectangular or square cross section for use in buildings and other structures and more particularly to the production of such pipe from a single plate.

Such a large-sized steel pipe having a rectangular or square cross section (hereinafter referred to simply as "square steel pipe") is usually produced by bending two steel plates into U-shaped cross sections respectively and joining the bent plates by butt welding. Since the steel pipe thus produced has two weld lines, the welding material and operation account for a substantial portion of the cost of the steel pipe, and removal of the strain resulting from the welding operation is similarly costly. These factors present difficulties in reducing the manufacturing cost of steel pipes. Whereas steel pipes of small size can be produced by bending a steel plate and welding the plate along a single line, production of large-sized steel pipes, 350 mm×350 mm or larger in cross section, usually involves many difficulties in the bending of the material and in the other processing steps, so that it has not been practical heretofore to produce large-sized steel pipes from a single plate.

SUMMARY OF THE INVENTION

An object of this invention is to produce a large-sized square steel pipe from a single steel plate and to thereby achieve a great reduction in the amounts of welding and processing required.

Another object of this invention is to provide square steel pipes having highly planar sides and uniformly curved corner portions.

To fulfill these objects, the present invention in one aspect thereof provides a process comprising the steps of press-forming a steel plate into a shape resembling a square pipe having a base and sidewalls which are bent at angles slightly larger than 90 degrees relative to the base to provide corner portions, placing inner rolls inside the formed plate with outer rolls positioned on the outer sides of the formed plate. The inner rolls are shaped in corresponding relation to the side of the plate where the opposed side edges of the plate are to be joined together and to the opposite sides thereof immediately adjacent said said. The inner and outer rolls are moved longitudinally of the formed plate to further form the plate while pressing the plate with the outer rolls from outside. Thereafter the side edges of the plate are welded together. The steel plate is formed into the square pipe resembling shape so that the opposite side edges of the plate will be joined together in the center of one side of the square steel pipe thus obtained. The plate is prepared from a steel sheet by cutting the sheet either to a specified size or by paying off a strip of the steel from a roll of steel strip and by cutting the strip to the specified size. The side edges are automatically welded together by submerged arc welding from outside and inside or by high frequency welding. When high frequency welding is resorted to, there is no need to prepare the edges for welding, nor is it necessary to weld the edges from both inside and outside. The formed plate can, therefore, be welded efficiently.

Other objects and features of this invention will become apparent from the following description.

DESCRIPTION OF THE PREFERRED EMBODIMENT

Figure 1:
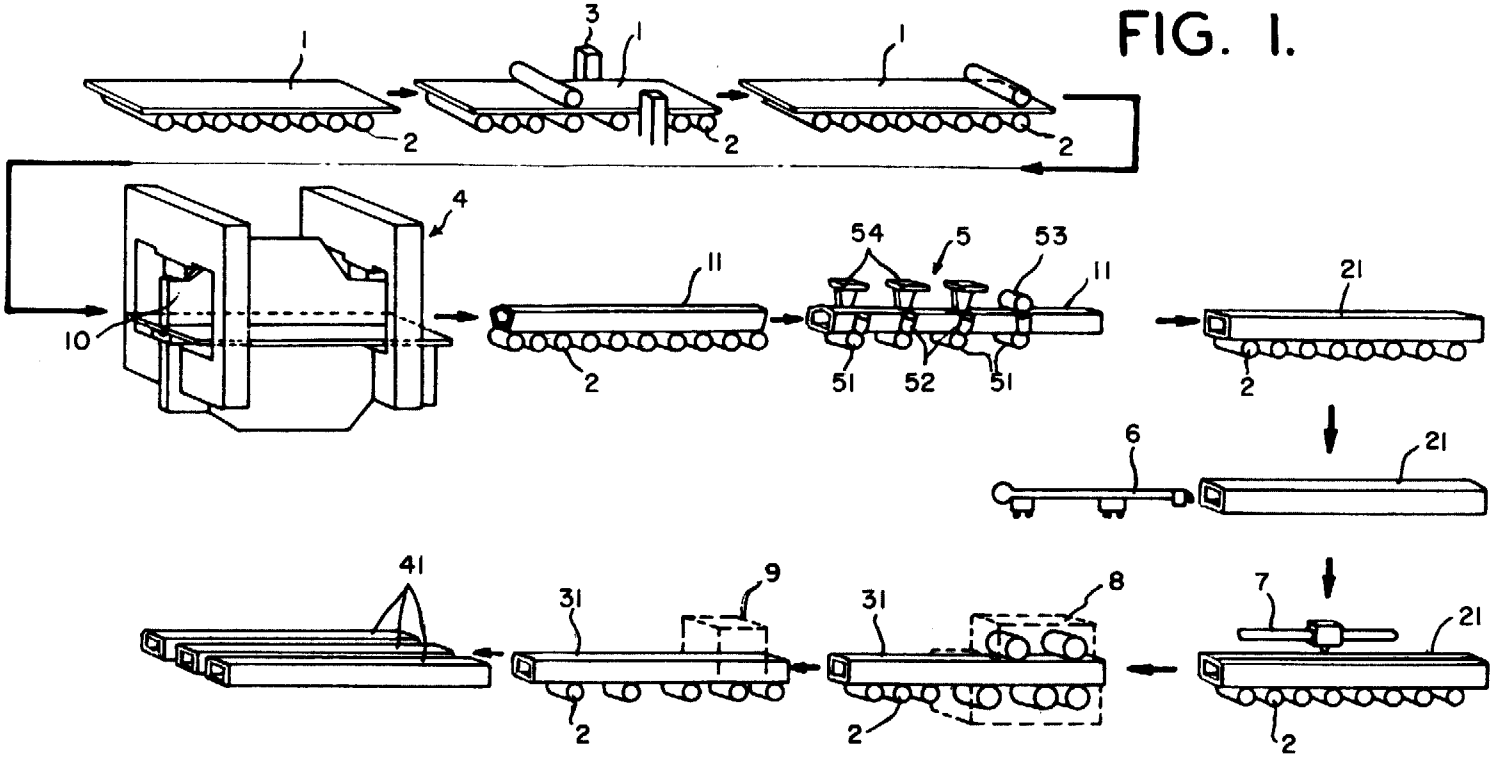
FIG. 1 is a diagram showing a process embodying this invention.

With reference to the drawings, a steel sheet material is cut at a feeding station by gas or by shears, a slitter or the like into a plate of specified size. The steel plate 1 is held in position by unillustrated opposite pinch rolls and is fed by feed rolls 2 to an edge preparing device 3, by which opposite side edges of the plate are prepared for welding. The plate is further sent forward by the feed rollers 2 into a forming press 4, in which a plate-shaped die 10 presses the plate 1 over its entire length to form, by bending the corner portions of the square steel pipe to be produced. By this forming operation, a corner 12 is first bent into a predetermined angle, then a corner 13, further a corner 15 and thereafter a corner 14 (see FIG. 2). Preferably the corners 12 and 15 have an angle A of 90 degrees, and the corners 13 and 14 an angle B of 110 degrees. The steel plate 1 is thus press-formed into a shape resembling the square steel pipe to be produced and having the cross section indicated in solid lines in FIG. 2. The primary formed product 11 obtained is withdrawn from the forming press 4 and is fed to a forming roll unit 5 by feed rollers 2.

The forming roll unit 5 comprises a group of outer rolls including lower rolls 51, side rolls 52, 52 disposed on opposite sides and rotatable via a common shaft, an upper roll 53, and freely rotatable inner rolls 54, 54 adapted to be placed into the formed product 11. A plurality of sets of rolls, each comprising one lower roll 51, a pair of opposite side rolls 52, 52 and a pair of inner rolls 54, 54, are arranged longitudinally of the formed product. The final set of rolls does not include any inner rolls 54, which by then have been withdrawn, but includes the upper roll 53 to provide four rolls on the four sides of the formed product 11 outside thereof. With the sets of lower, side and inner rolls 51, 52, 54, the bottom side 16 of the product 11 is pressed from inside by the inner rolls 54, 54 against the lower rolls 51, while opposite sides 17, 18 of the product 11 are pressed from outside by the side rolls 52, 52 so that the opposed side edges of the plate 1 will be brought toward each other, whereby the preformed product 11 is further formed stepwise. The final set of outer rolls 51, 52, 52, 53 presses the product 11 on the four sides into the desired tubular shape. (See FIGS. 3 and 4.)

Figures 2, 3, 4:
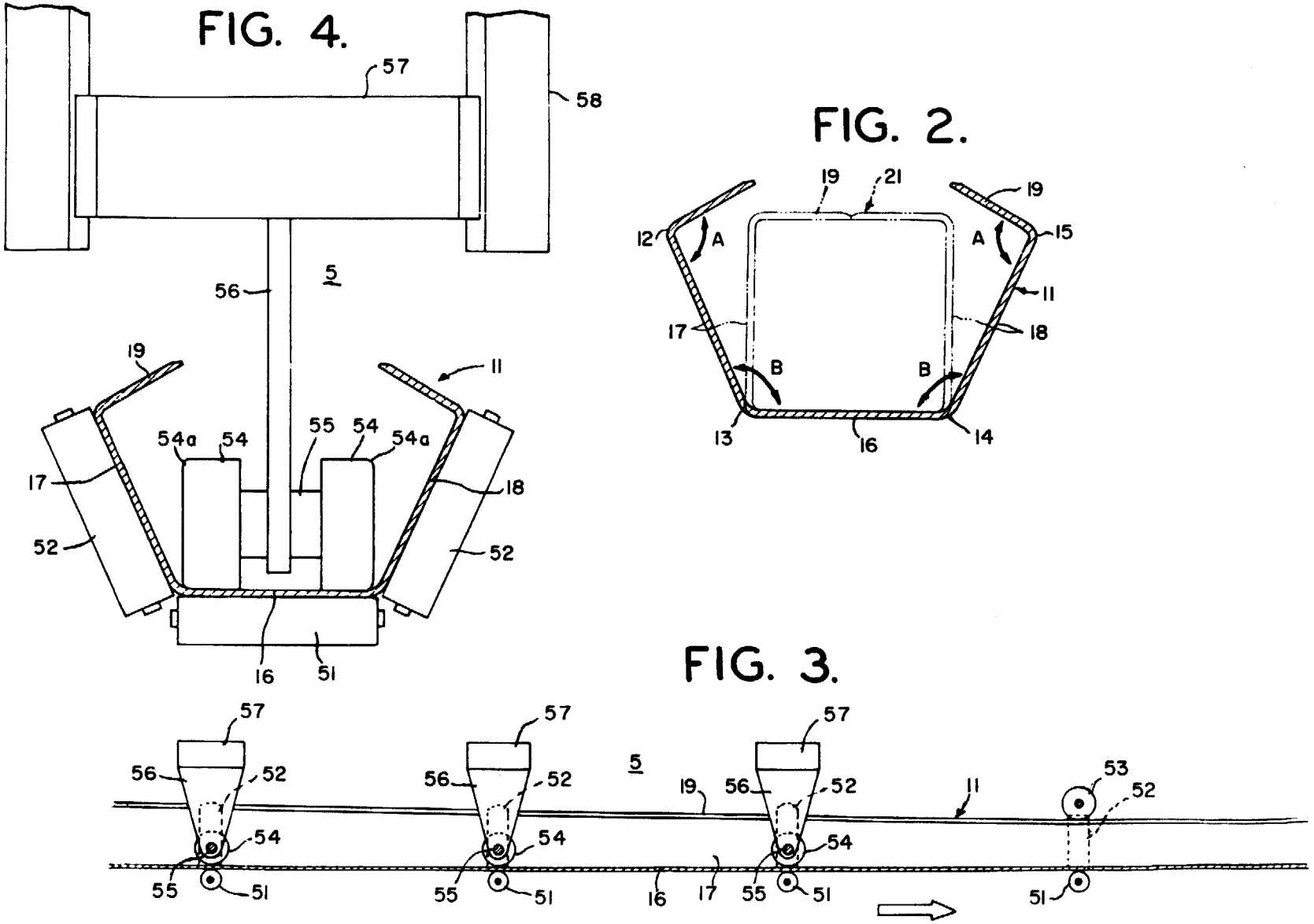
FIG. 2 is a cross sectional view showing a plate formed by bending.
FIG. 3 is a side elevational view showing the plate of FIG. 2 while it is being further formed by forming rolls.
FIG. 4 is a view similar to that of FIG. 2 with the inner rolls positioned within the bent plate.

The inner rolls 54, 54 may be held in contact with the inner surface of the bottom side 16 over the entire width thereof or on the opposite side portions thereof only as shown in FIG. 4. The rolls 54, 54 have accurately planar outer side faces and outer side peripheral corners **54*a*, 54*a*** having the same specified radius of curvature as the inside corners of the steel pipe to be produced. The inside radius of curvature, R, of the corners of the steel pipe varies with the thickness of the plate material. For example, square steel pipes 350 to 600 mm in the dimension of one side, have the following inside radii of curvature, R.

| Plate thickness (mm) | R (mm) |
|---|---|
| 9 | 24 |
| 12 | 24 |
| 16 | 45 |
| 19 | 45 |
| 22 | 75 |
| 25 | 75 |

In FIGS. 3 and 4, indicated at 55 are the rotary shafts of the inner rolls 54, 54, at 56 members for supporting the shafts 55, and at 57 supports which, when raised or lowered along guides 58, bring the inner rolls 54, 54 upward or downward to an adjusted position in accordance with the cross sectional dimensions of the steel pipe to be produced.

The use of the forming roll unit 5 assures that the workpiece eventually formed will have highly planar sides 16, 17, 18, 19 and corner portions with a uniform radius of curvature. When the primary formed product 11 is to be formed into a specified steel pipe by being pressed only with sets of outer rolls on four sides from outside throughout the whole forming process, the pressure acting on the work piece 11 from above will cause outwardly bulging of the opposite sides 17, 18 and especially the bottom side 16, further resulting in the likelihood that the opposite bottom corners 13 and 14 will have a larger radius of curvature than desired. According to the present invention, however, the inner rolls 54, 54 press the bottom side 16 from inside against the lower roll 51 which supports the bottom side 16, thus restraining the bottom side 16 from both inside and outside to make the bottom side planar, while bending the bottom corner portions 13 and 14 along the outside peripheral corners 54*a* and 54*a* of the inner rolls 54 accurately to the specified radius of curvature. The opposite sides 17 and 18 can also be formed to a planar shape by being pressed with the side rolls 52 and 52 against the inner rolls 54 and 54. Thus the forming operation of the invention produces highly planar sides and uniformly curved corners having the desired radius of curvature.

In this way, a secondary formed product 21 is obtained which is in the shape of a steel pipe as specified. The opposed side edges are then tack-welded by an unillustrated welding machine. Subsequently the work piece is fed by feed rollers 2 to a welding process, in which the work piece is welded from inside and outside by automatic welding machines 6, 7, whereby the desired square steel pipe 31 is obtained.

The secondary formed product 21 may be welded by submerged arc welding or high frequency welding. When the latter method is resorted to, the work piece can be welded through the entire thickness of the plate, so that there is no need to weld the work piece from both inside and outside separately. The work piece can be completely welded by a single pass. Additionally high frequency welding, which unlike submerged arc welding uses no deposited metal, serves to reduce the amount of heat needed and mitigates the strain produced in the resulting product. This method of welding does not require edge preparation and is therefore simple to perform. Either high frequency induction welding or high frequency resistance welding can be resorted to for this type of welding operation.

The square steel pipe 31, when completely welded, is sent forward by feed rollers 2 and passed through a reforming press 8 for the removal of strain. The pipe 31 is thereafter passed through a tester 9, such as an ultrasonic flaw detector, in which the weld zone is examined. In this way a finished product 41 is obtained.

Figure 5:
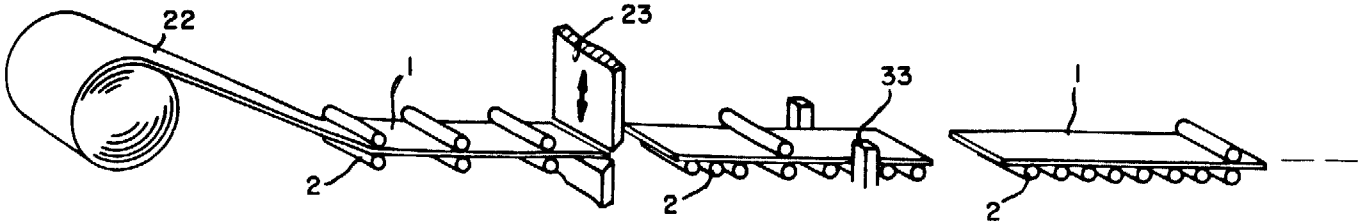
FIG. 5 is a diagram showing another mode of feeding the plate material.

Alternatively the material may be fed in the mode shown in FIG. 5, in which it is seen that a steel strip is paid off from a coil 22 of strip and passed over rolls 2 for levelling. The continuous strip 1 is cut to a predetermined length by a shearing device 23, and the cut sheet is trimmed at opposite sides by a cutter 33 while being sent forward longitudinally thereof by transfer rollers 2. The steel plate thus cut to the desired size is fed to the forming press 4 by rollers 2 and subjected to the steps already described. The use of the coil 22 is convenient in that when steel pipes of varied length are to be produced, the shearing device 23 needs only to be shifted, thus eliminating the necessity of interrupting the operation to change the dimension of the work piece.

The whole process described above, from the feeding of the material through the delivery of the finished product, may be practiced in a single line, or the inner welding operation and the following steps may be performed in two divided concurrent lines since these steps take a relatively long period of time.

According to the present invention, a square steel pipe having a single weld line can be produced from a steel plate. Consequently the present process requires only one half the welding amount needed for the conventional process in which two channel members are joined together by butt welding. This means a 50% reduction in the amounts of welding material, in the welding operation and in edge preparation. The reduced weld zone results in less strain produced and in reduced work needed for the removal of strain. Moreover the use of the forming roll unit comprising lower rolls, side rolls, upper roll and inner rolls assures that the steel pipes obtained have highly planar sides and uniformly curved corner portions. Because of these advantages, the present invention is commercially very valuable in that square steel pipes can be manufactured with high quality at a low cost.

We claim:

1. A process for producing large-sized steel pipe of rectangular or square configuration having planar sides and uniformly curved corners from a thick metal plate, comprising:

bending a thick metal plate of from 9 to 25 mm thickness to form a longitudinally extending base, opposed sidewalls angularly disposed relative to said base at respective angles greater than 90°, and a top wall constituted by inwardly directed extensions of said sidewalls which terminate in spaced apart longitudinally extending edges, said extensions being angularly disposed against said sidewalls at respective angles of about 90°, positioning a first forming roll unit having a horizontal first outer lower roll, two first outer side rolls angularly disposed relative to said first outer lower roll at greater than 90° and a first inner roll having an outer cylindrical surface and outwardly facing substantially planar faces generally perpendicular to the axis of said cylindrical surface, said cylindrical surface being joined to said outwardly facing planar faces by first curved portions having a radius of from 24 to 75 mm depending on the thickness of said metal plate, said first outer lower roll and said first outer side rolls being respectively in contact with the underside of said base and said sidewalls of said bent plate, adjusting the vertical position of said first inner roll to an adjusted position according to the cross sectional dimension of the steel pipe to be produced such that said first inner roll is in contact with the inside of said base of said bent plate, said horizontal first outer lower roll, said two first outer side rolls and said first inner roll each having an axis of rotation disposed in a first common plane such that said base is sandwiched between said first inner roll and said horizontal first outer lower roll at a position aligned with said two first outer side rolls, positioning one or more second forming roll units each having a horizontal second outer lower roll, two second outer side rolls angularly disposed relative to said second outer lower roll at greater than 90° but less than the angle at which said two first outer side rolls are angularly disposed relative to said first outer lower roll, and a second inner roll having an outer cylindrical surface and outwardly facing substantially planar faces generally perpendicular to the axis of the last said cylindrical surface, said cylindrical surface being joined to said outwardly facing planar faces by second curved portions having a radius of from 24 to 75 mm depending on the thickness of said metal plate, said second outer lower roll and said second outer side rolls being respectively in contact with the underside of said base and said sidewalls of said bent plate, and adjusting the vertical position of said second inner roll to an adjusted position according to the cross sectional dimension of the steel pipe to be produced such that said second inner roll is in contact with the inside of the base of the bent plate, said horizontal second outer lower roll, said two second outer side rolls and said second inner roll each having an axis of rotation disposed in a second common plane such that said base is sandwiched between said second inner roll and said horizontal second outer lower roll at a position aligned with said two second outer side rolls, positioning a third forming roll unit situated after said first and second forming roll units, said third forming roll unit having a horizontal third outer lower roll, two vertical third outer side rolls and an upper roll, said third outer lower roll being in contact with the underside of said base, said third outer side rolls being in contact with said sidewalls, and said upper roll being in contact with said top wall;

effecting relatively longitudinal movement of said bent plate between said first and second forming roll units to thereby stepwise bend said sidewalls and simultaneously bend the corners between said sidewalls and said base against said first and second curved portions of said first and second inner rolls respectively such that said curved corners conform to the curved configuration of said curved portions of said first and second inner rolls, said sidewalls being bent against said planar faces so as to be disposed at about 90° relative to said base, said first and second common planes being perpendicular to said direction of longitudinal movement of said bent plate, pressing said plate on its four sides by said third forming roll unit into the desired rectangular or square configuration of from 350 to 600 mm with said longitudinal extending extensions in abutting relationship; and welding said abutting longitudinal extending extensions to form said steel pipe having planar sides and uniformly curved corners.

* * * * *